US005758700A

United States Patent [19]

Vanderploeg

[11] Patent Number: 5,758,700

[45] Date of Patent: Jun. 2, 1998

[54] BOTTLE CAP INTERLOCK

[76] Inventor: Richard D. Vanderploeg, 1100 Burloak Drive, Burlington, Ontario, Canada, L2L 6B2

[21] Appl. No.: 766,887

[22] Filed: Dec. 13, 1996

Related U.S. Application Data

[63] Continuation of Ser. No. 110,928, Aug. 24, 1993.

[51] Int. Cl.[6] ..... B65B 3/04

[52] U.S. Cl. ..... 141/347; 141/18; 141/354; 141/384; 141/386; 141/113; 141/67; 99/323.1; 215/315; 261/64.3; 261/122.1; 261/DIG. 7; 222/325; 403/349

[58] Field of Search ..... 141/347, 2, 14, 141/17, 18, 20, 21, 22, 67, 70, 113, 325, 346, 351–354, 360–362, 368–372, 383, 384, 386; 215/312, 315; 261/64.3, 122.1, DIG. 7; 426/477; 403/348–349; 137/614.05, 614.2; 99/323.1; 222/325

[56] References Cited

U.S. PATENT DOCUMENTS

| | | | |
|---|---|---|---|
| 1,912,439 | 6/1933 | Feller | 426/477 |
| 2,345,081 | 3/1944 | Ward | 141/17 X |
| 3,237,809 | 3/1966 | Daragan et al. | 222/325 X |
| 3,592,244 | 7/1971 | Chamberlin | 141/14 |
| 4,395,940 | 8/1983 | Child et al. | 99/323.1 |
| 4,510,969 | 4/1985 | Rodth | 137/614.05 |
| 4,610,282 | 9/1986 | Brooks et al. | 426/477 X |
| 4,619,297 | 10/1986 | Kocher | 141/20 |
| 5,259,423 | 11/1993 | Simmel et al. | 141/346 |
| 5,260,081 | 11/1993 | Stumphauzer et al. | 426/477 |
| 5,299,608 | 4/1994 | Bosyj | 141/21 X |
| 5,397,196 | 3/1995 | Boiret et al. | 403/348 |
| 5,425,404 | 6/1995 | Dyer | 141/351 |

FOREIGN PATENT DOCUMENTS

| | | | |
|---|---|---|---|
| 1004591 | 11/1972 | Canada . | |
| 1025272 | 6/1974 | Canada . | |
| 1061312 | 2/1975 | Canada . | |
| 1600893 | 7/1980 | Canada . | |
| 1168086 | 8/1980 | Canada . | |
| 2662755 | 12/1991 | France | 403/349 |

*Primary Examiner*—J. Casimer Jacyna
*Attorney, Agent, or Firm*—Eugene J.A. Gierczak

[57] ABSTRACT

In an interlocking device between a cap for a beverage container and a carbonation device for introducing carbon dioxide gas into said beverage container in a locked position, wherein said carbonation device includes projecting structure, and said cap includes rotatable capturing structure for capturing said projecting structure so as to lock said cap to said carbonation device.

7 Claims, 7 Drawing Sheets

BOTTLE CAP INTERLOCK

This is a continuation of application Ser. No. 08/110,928, filed Aug. 24, 1993 and still pending.

FIELD OF INVENTION

This invention relates to an interlocking device and particularly relates to an interlocking device between a cap for a beverage container and carbonation device.

BACKGROUND OF THE INVENTION

Various types of carbonation units have been used in the past. Such carbonation devices may either use dry ingredients that are dissolved in water to form carbon dioxide gas by chemical reaction so as to carbonate the water. Such prior art devices, however, are messy and tend to leave residuals from the chemical reactions. Examples of such prior art devices are illustrated in Canadian Patents Nos. 1,168,086; 1,600,893; 1,025,252; 1,025,272 and 1,004,591.

Moreover, there are other prior art devices which use carbon dioxide canisters which are utilized for a single charge but then need to be replaced. Examples of such units include U.S. Pat. Nos. 2,805,846; 4,222,972. Other single charge cartridge systems are known but their functionality is limited due to the requirement of constantly needing to replace the carbon dioxide canister.

A carbonator for gasifying liquid having an injunction passage closed by a one-way non-return valve is taught by U.S. Pat. No. 4,999,140.

Increasing interest in home carbonation systems have resulted in a number of units utilizing more substantial carbon dioxide gas cylinders, with the capacity for carbonating a much larger volume of liquids. Examples of such systems in the prior art include U.S. Pat. Nos. 4,481,986 and 4,927,569.

Moreover, applicant has filed U.S. patent application Ser. No. 08/031,715 on 03/15/93 disclosing a carbonation device which is improved over the prior art.

It is an object of this invention to provide an improved carbonation device than that disclosed by the prior art. It is a further object of this invention to provide an improved interlocking device between a cap for a beverage container and a carbonation device.

An aspect of is invention relates to an interlocking device comprising a cap for beverage container; projecting means protruding from a carbonation device where said carbonation device introduces carbon dioxide gas into said beverage container; a plurality of radially extending ribs on the exterior surface of said cap, wherein said ribs run axially along the length of said cap; rotatable capturing means on said cap, extending outwardly beyond the exterior surface of said cap for capturing said projecting means so as to lock said cap to said carbonation device.

Another aspect of this invention relates to an interlocking device comprising a cap for a beverage container; three projecting locking pins disposed 120° relative to each other, said projecting locking pins protruding from a carbonation device where said carbonation device introduces carbon dioxide gas into said beverage container; a plurality of radially extending ribs on the exterior surface of said cap, wherein said ribs run axially along the length of said cap for enlarging the body of said cap; and three spaced apart flanges disposed 120° relative each other and extending radially outwardly beyond said exterior surface of said cap, said flanges adapted to receive said locking pins between said spaced flanges and to slide under said locking pins when said cap is rotated so as to capture said projecting means so as to lock said cap to said carbonation device; a nozzle presented by said carbonation device; a cavity presented by said cap, said cavity adapted to receive said nozzle and to hold said nozzle securably in place; sealing means disposed between the surface of said nozzle and said cavity; and plunging means centrally disposed within said cavity to open said nozzle when said nozzle is inserted fully into said cavity and said cap is locked to said carbonation device.

The final aspect of this invention relates to a device for carbonating beverages including a housing presenting a passage means; a high pressure carbon dioxide container releasably securable to said housing at one end of said passage means; a beverage container releasably engagable with said housing for communication with another end of said passage means; a valve body associated with said passage means extending longitudinally so as to present two opposite ends thereof with a bore extending between said ends, and a hole disposed between said ends and communicating, with said bore and defining an outlet; a valve disposed within said valve body adjacent said one end of said ends defining an inlet for communication with said passage, said valve moveable between an open position to permit communication of said gas from said carbon dioxide container, through said passage, inlet and outlet to said beverage container so as to carbonate said beverage, and a closed position to stop communication of said gas between said inlet and said outlet, a piston extending through said other end of said valve body to said bore for actuating said valve between said open and closed position, a support disposed within said bore adjacent said other end of said valve body for slidably supporting said piston between said open and closed position; a moveable switch for moving said piston and said valve between said open and closed positions; pressure regulating means for reducing the pressure of said pressurized gas from said carbon dioxide container to said beverage container; a cap for sealing the end of said beverage container to be carbonated by the release of said pressurized gas from a nozzle having a valve, said cap including cavity means for sealingly receiving said nozzle and engaging said valve to release said carbonated gas, said cap including cap passage means for communication of said carbonation gas from said valve to said end of said beverage container, and a cap valve means moveable between a closed position to close said end of said beverage container and an open position so as to carbonate said beverage when said cavity means engages said valve to release said carbonated gas; said housing including a plurality of projecting locking pins, and said cap including a plurality of radially extending ribs running axially along the length of the cap and a plurality of radially extending flanges adapted to rotatably capture said locking pin so as to lock said cap to said locking pins during carbonation of said beverage container.

DRAWINGS

DESCRIPTION OF THE INVENTION

Like parts have been given like numbers throughout the figures.

Figure 1:
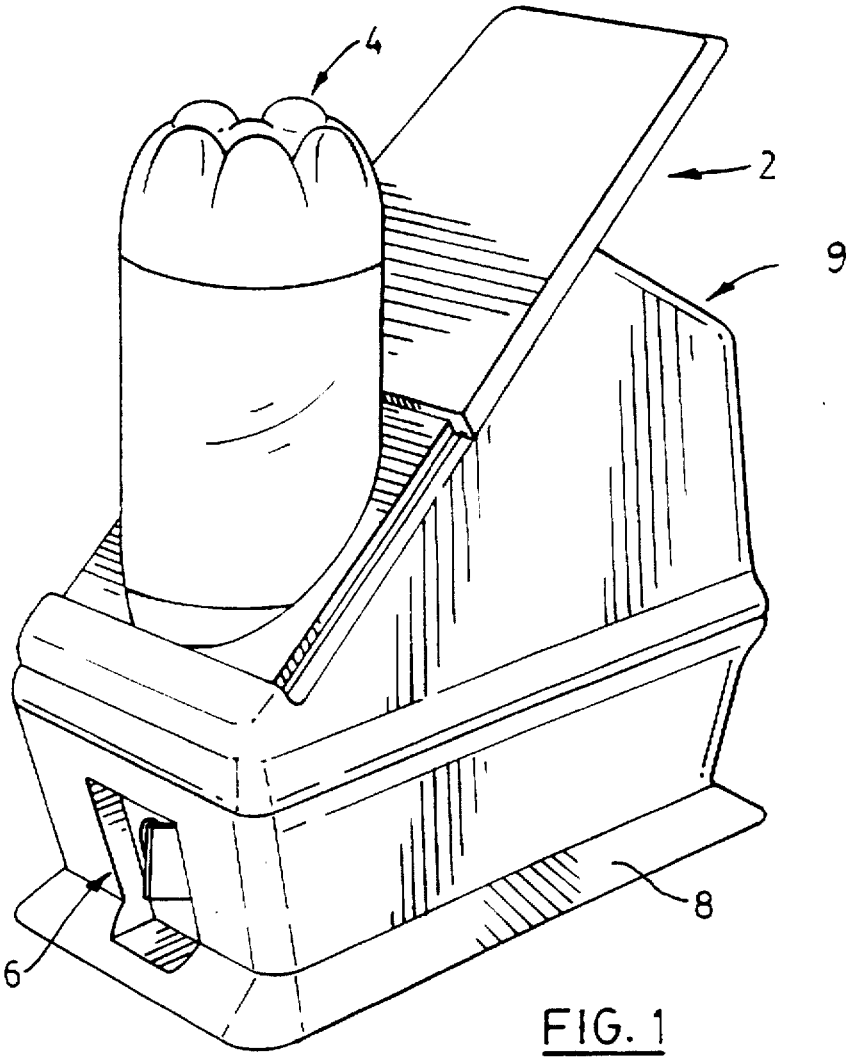
FIG. 1 is a perspective view of the carbonation device.
Figure 2:
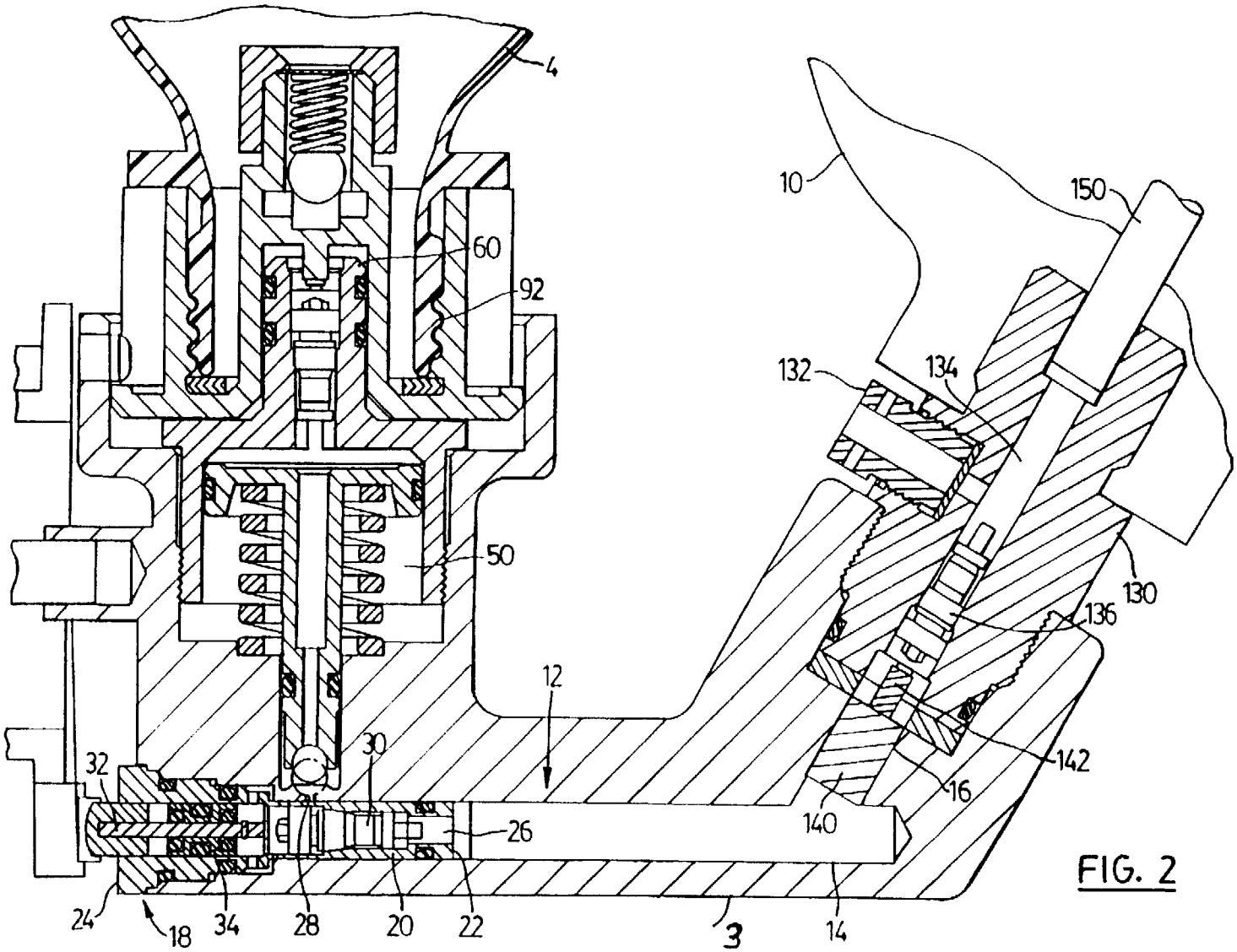
FIG. 2 is a cross-sectional view of the housing showing the carbonation container and beverage container.
Figure 3:
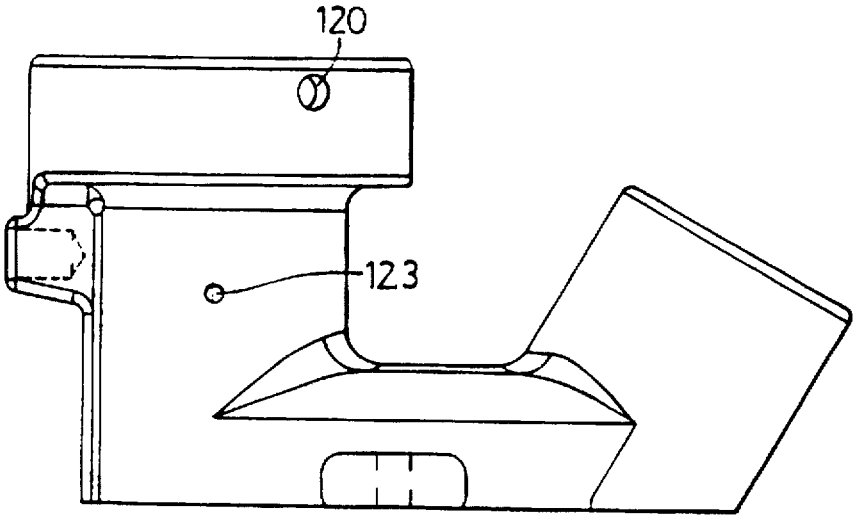
FIG. 3 is a side-elevational view of the housings.
Figure 4:
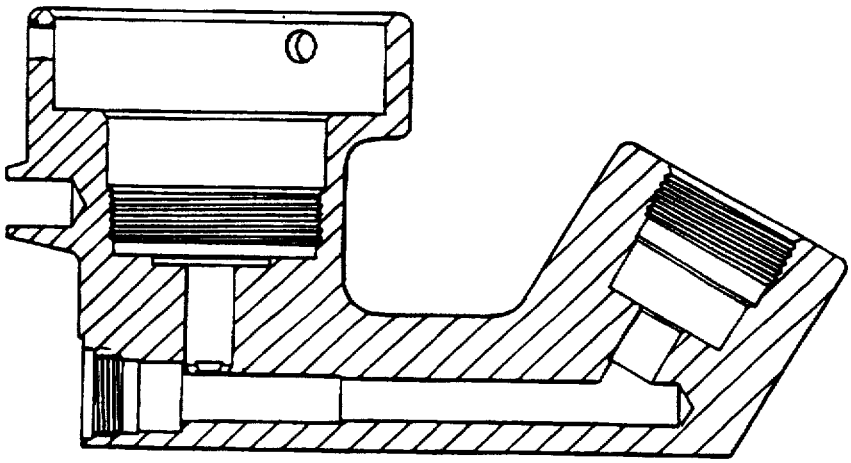
FIG. 4 is a cross-sectional view of the housing.

FIG. 1 is a perspective view of the carbonation device 2 illustrating the beverage container 4, switch 6, base 8, cover 9. The carbon dioxide container 10 is not shown in FIG. 1 but is best illustrated in FIG. 2. Side elevational views and cross sectional views of the housing 3 are shown in FIGS. 3 and 4. The housing 3 shown in FIGS. 2, 3 and 4 is comprised of any number of materials such as plastic but preferably brass.

The housing 3 includes a passage means generally illustrated by the numeral 12 which provides a passage from carbon dioxide container 10 to the beverage container 4. In particular, the passage 12 comprises a hole 14 drilled horizontally through the housing 4 and a second hole 16 drilled at an obtuse angle relative the first hole 14. The passageway 12 is adapted to receive a high-pressure relief valve or means 18 which is comprised of brass or the like. In particular the valve means 18 comprises a valve housing 20 which extends longitudinally along the length thereof so as to present two opposite ends 22 and 24. The valve housing 20 also includes a bore 26 extending between the opposite ends 22 and 24 as well as a hole 28 which extends through the valve housing 22 between the ends 22 and 24.

The valve housing 20 also includes a high-pressure valve 30 which is disposed adjacent one end of the valve housing as best illustrated in FIG 2.

The other end 24 of the valve housing includes a piston 32 which is adapted to travel between a first and second or closed and opened position to be more fully described herein. In particular, the piston 32 is adapted to move from left to right as shown in FIG. 2 so as to contact the valve 30 and thereby move the valve from a closed position to an open position which will permit the introduction of carbon dioxide gas into the beverage container 4 to be more fully described herein.

Figure 5:
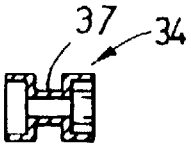
FIG. 5 is a cross-sectional view of the support.

The valve housing 20 also includes a support 34 which is best particularized in FIG. 5.

Figure 6:
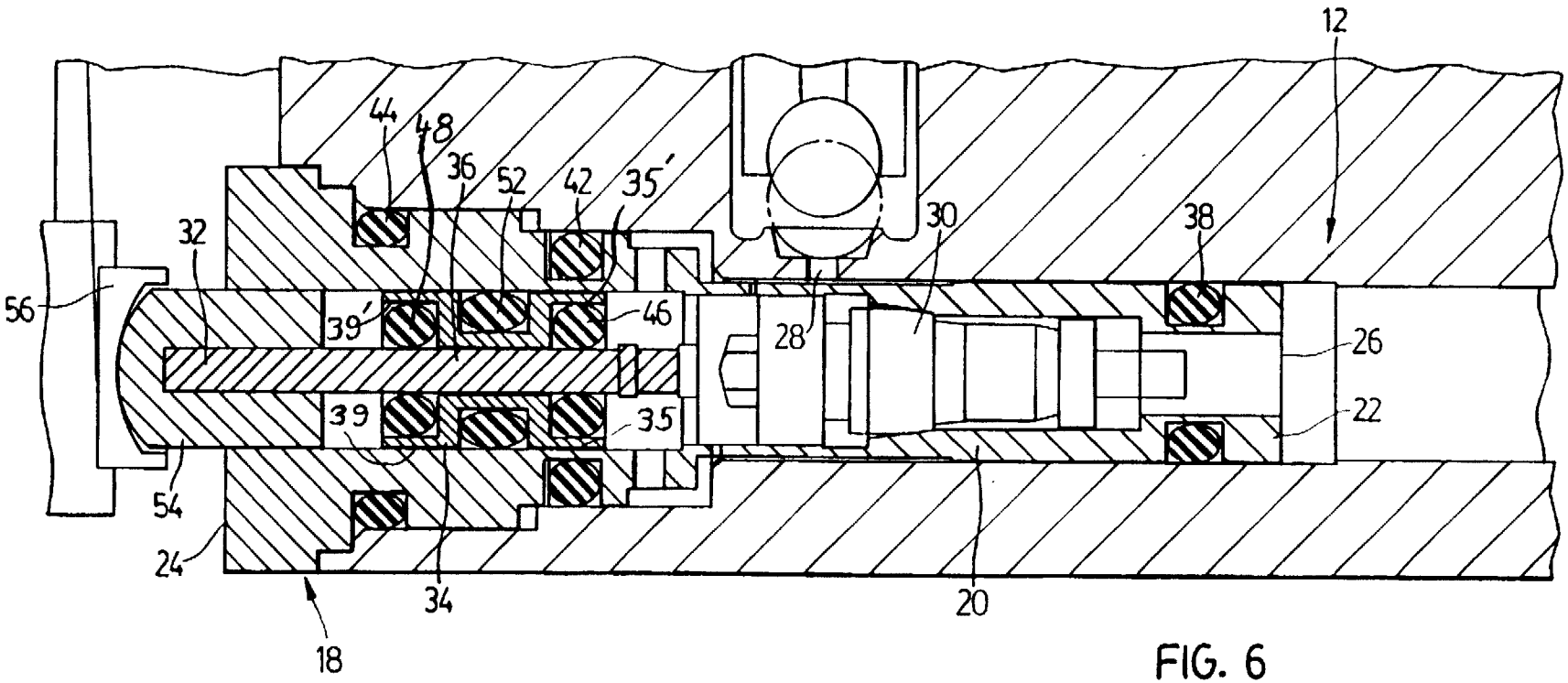
FIG. 6 is a an enlarged cross-sectional view of the high-pressure relief valve.

FIG. 6 also presents an enlarged view of the high-pressure relief valve means the passage 12 or hole 14, valve housing 20, piston 32 and support 34 are coaxially disposed or arranged within the passage 12.

The piston 32 is adapted to be moved between a first or closed position as shown in FIG. 6 whereby the piston or plunger 32 is spaced from the valve 30 so as to close the communication of carbon dioxide gas from the cannister 10. When piston 32 is moved from the closed position to the open position, the piston moves from a position where the piston is spaced from the valve to a position where the piston 32 contacts the valve 30 such that the valve 30 is activated into the open position so as to permit the communication of carbon dioxide from the canister 10.

The bore 26 in the vicinity of one end 22 of the valve housing defines an inlet for the introduction of carbon dioxide gas while the hole 28 defines an outlet. In the closed position illustrated in FIG. 6 the carbon dioxide gas is prevented from moving through the valve 30.

The piston or plunger 32 is adapted to be moved by a switch 40 which causes the piston 32 to move towards the right as shown in FIG. 6 so as to contact the valve 30 thereby opening the passage between the inlet 26 and outlet 28 of the valve means 18 so as to cause the flow of carbon dioxide gas up into the pressure regulating means 50 and then up into the beverage container 4.

Once the beverage container 4 is sufficiently carbonated, the switch 40 may be moved so as to cause the piston 32 to move towards the left as shown in FIG. 6 so as to move away from the valve 30 and thereby close the outlet 28, as further described below.

The high-pressure relief valve 18 also includes a support 34 which includes a hole 36 which is adapted to slidingly receive the piston 32. Support means 34 comprises a spool and is positioned within valve housing 20 to slidably receive piston 32. Support means 34 has an outer cylindrical surface 35 and intermediate cylindrical surface 37 of smaller diameter than surface 35 and a third cylindrical surface 39 having a diameter substantially equal to that of surface 35. Those portions of support means 34 defined by outer cylindrical surfaces 35 and 39 have corresponding interior cylindrical surfaces $35^1$ and $39^1$ which are adapted to receive and securably hold O-rings 46 and 48 respectively O-rings 46 and 48 positioned within interior of cylindrical surface $35^1$ and $39^1$ respectively are adapted to minimize the escape of pressurized gas between the piston 32 and support means 34. In particular, the support comprises a spool for slidably receiving the piston, the spool having a first end and a second end and a medial rebate tberebetween around which to mount a seal ring, namely O-ring 52; and wherein the first and second ends present first and second cups respectively wherein each said cups receive a seal ring, namely O-ring 46 and O-ring 48 respectively. High pressure relief valve 18 includes O-ring 52 which is positioned in valve housing 20 and mounted around exterior cylindrical surface 37 of support means 34 as shown in FIG. 6. O-ring 52 provides sealing of support means 34 in valve housing 20 and retains cord means 34 therein, thereby minimizing the escape of pressurized gas.

The high-pressure relief valve means 18 includes O-rings 38, 42 and 44 so as to minimize the escape of carbon dioxide gas between the valve housing 20 and housing 3. Furthermore the support 34 also includes O-rings 46 and 48 which are adapted to minimize the escape of pressurized gas between the piston 32 and support 34. Moreover the support 34 also includes O-ring 52 so as to minimize the escape of carbon dioxide gas between the support 34 and the valve housing 20.

Figure 7:
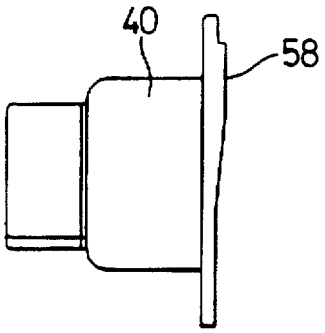
FIG. 7 is a side-elevational view of the switch.
Figure 8:
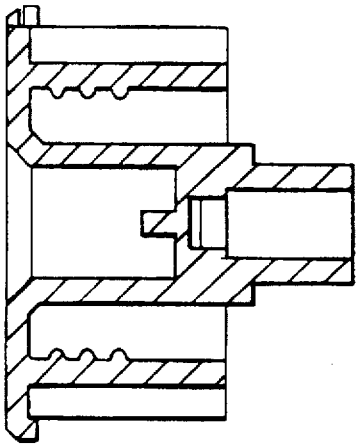
FIG. 8 is a cross-sectional view of the cap.
Figure 9:
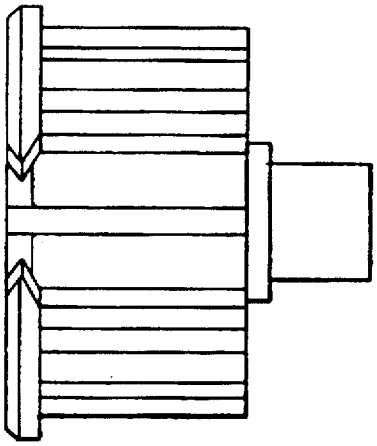
FIG. 9 is a side-elevational view of the cap.

The high-pressure relief valve 18 also includes a push button 54 which is adapted to contact the end of the piston 32 as well as a pad 56 which assists in minimizing wear between the switch 40 and push button 54. FIG. 7 illustrates the switch 40 which is adapted to be rotated. The switch 40 also includes a cammed surface 58 adapted to push against the pad 56 and thereby the push button 54 and the piston 32. Once the contents of the beverage container 4 are adequately carbonated, switch 40 is rotated in a direction opposite that required to open high-pressure relief valve 30. Such rotation causes cammed surface 58 to draw pad 56 and thereby draw the push button 54 and piston 32 to the left, thereby closing high-pressure relief valve 30.

Once the carbon dioxide gas passes through passage 12 through valve 30, the carbon dioxide gas passes through pressure regulator 50 and up into the nozzle 60.

Figure 11:
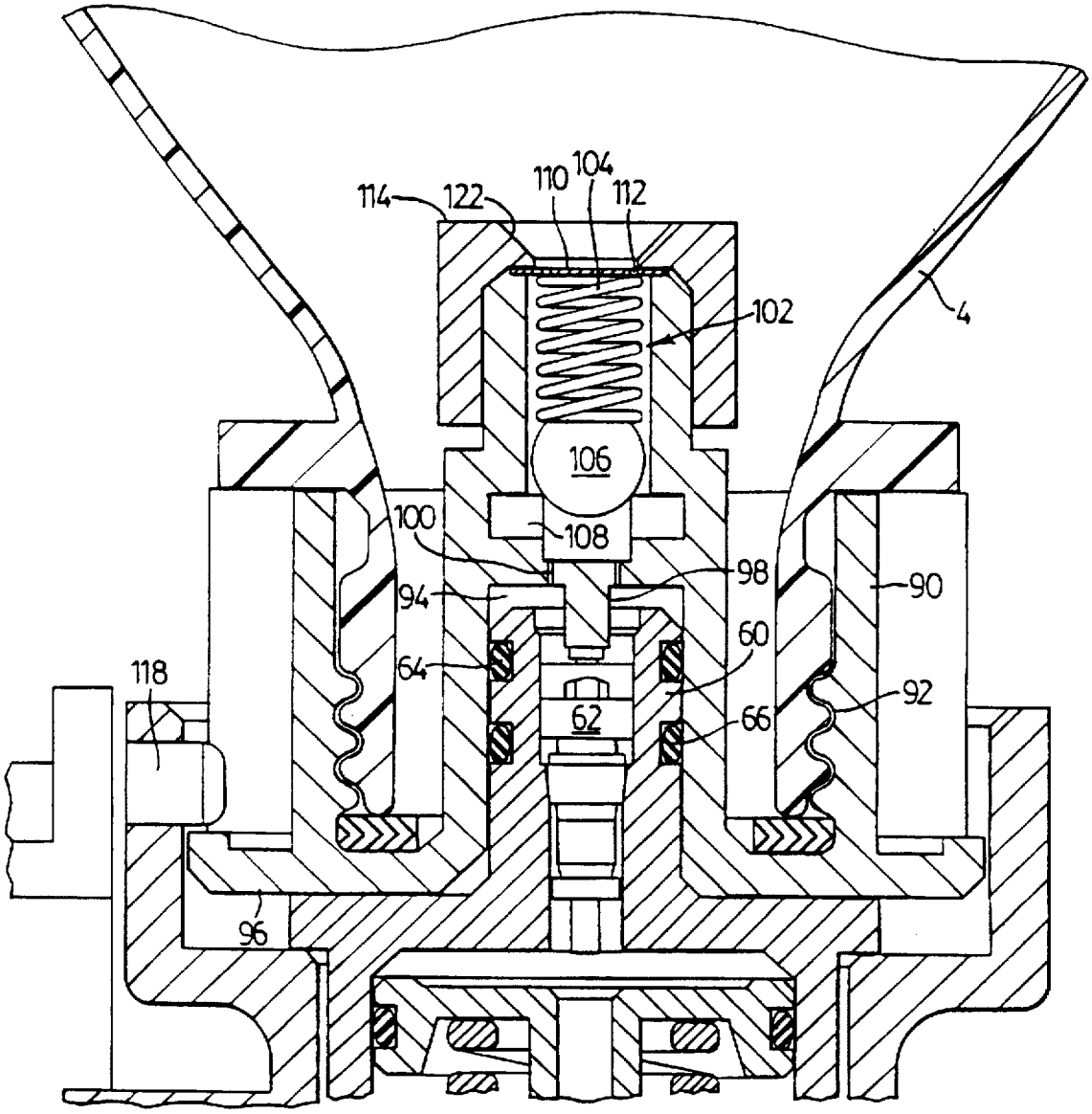
FIG. 11 is a cross-sectional view of the cap and nozzle.

FIG. 11 more fully particularizes the nozzles 60 and cap 90. The nozzle 60 also includes a nozzle valve 62 which is biased in a closed position. Accordingly a cap 90 is utilized in order to activate the nozzle valve 62 into an open position so as to permit the introduction of carbon dioxide gas into the beverage container 4 in a manner to be more fully described herein.

In particular the cap 90 includes thread means 92 to releasably secure the cap 90 to the beverage container 4. The cap may comprise of a number of materials including plastic. The cap 90 also includes a cylindrical cavity 94 presented along an exterior surface 96 thereof. The cavity 94 is adapted to slidingly, sealingly, receive and secure the nozzle 60 within cavity 94 of cap 90 as illustrated in FIG. 11.

The cavity includes a projecting, knob or plunger 98 which is adapted to contact the valve 62 so as to move the nozzle valve 62 between an open and closed position. In other words, the nozzle valve 62 is biased in a closed position to prevent the escape of carbon dioxide gas. However, upon inserting the cap 90 down onto the nozzle 60, the plunger 98 contacts the valve 62 such that the nozzle 60 is activated into the open position causing the release of carbon dioxide gas through the cap 90 in a manner to be more fully described herein.

The nozzle 60 includes O-rings 64 and 66 to minimize the escape of carbon dioxide gas between the nozzle 60 and cap 90.

The carbon dioxide gas flows through the cap 90 into the beverage container 4 as follows. Cap 90 includes a passage 100 having an inlet 131 for the introduction of carbon dioxide gas into the passage 100 and an outlet 133 for the escape of said gas into beverage container 4. Inlet 131 is situated adjacent to projecting knob or plunger 98. Outlet 133 is situated at the distal end of passage 100.

Cap valve means 102 is disposed within passage 100 between inlet 131 and outlet 133. Cap valve means 102 is moveable between a closed position to prevent the entry of $CO_2$ into beverage container 4 and an open position to permit the entry of $CO_2$ into the beverage container 4 when plunger 98 contacts the valve 62.

In particular, the cap valve means 102 comprises a spring 104 which is fixed to cap 90 near outlet 133. Spring 104 usages ball 106 to rest against valve seat 108 so as to block the flow of $CO_2$ gas between inlet 131 and outlet 133; cap valve 102 is biased in this closed position.

When plunger 98 contacts valve 62, the pressurized $CO_2$ gas is released from valve 62 and flows into passage 100 by means of inlet 131. Because the $CO_2$ gas is under high pressure, as it flows into the passage 100 it expands, causing ball 106 to move away form valve seat 108 and causing spring 106 to compress. In this open position, $CO_2$ gas flows from valve 62 into inlet 131, through passage 100, out of outlet 133 and into beverage container 4.

The cap 90 also includes output washer 110 at the extreme distal end of passage 100 at outlet 133. Output washer 110 has a plurality of apertures 112 through which the $CO_2$ gas must flow before entering beverage container 4.

Figure 12:
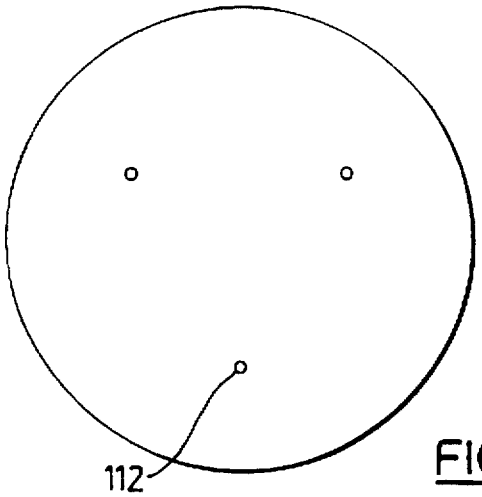
FIG. 12 is a top plan view of the washer.

FIG. 12 illustrates a top plan view of the output washer 110. Output washer 110 is retained in place by sonically welding a button cap or bonnet 114 as best illustrated in FIG. 11.

The number and size of apertures 112 in output washer 110 have been selected so as to maximize the flow rate of $CO_2$ into beverage container 4 so as to carbonate the contents thereof. A plurality of apertures 112 can be utilized although good results have been achieved by utilizing from two to four apertures each having a diameter in the range of $5/10{,}000$ to $19/5{,}000$ of an inch. Particularly good results have been achieved by using three apertures as illustrated in FIG. 12 which are 120 degrees apart and which apertures have a diameter of $8/1{,}000$ of an inch. By utilizing the size and number of apertures described herein particularly good results have been achieved in dissolving $CO_2$ gas in the contents of beverage container 4 so as to carbonate such contents.

Figure 15:
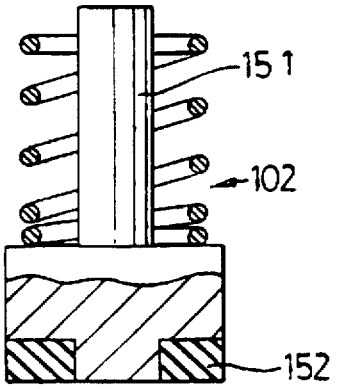
FIG. 15 is a plunger valve.

An alternative cap valve means 102 is shown in FIG. 15 showing that instead of using a ball 106, a plunger 150 is used with O-ring 152 to ensure positive closing.

The exterior surface of cap 90 includes a plurality of radially extending ribs 116 which run axially along the length thereof which ribs 116 are utilized to enlarge the body of cap 90.

Moreover, FIG. 11 also illustrates the interlocking mechanism between the cap 90 and the housing 3 of carbonation device 2. In particular the housing 3 includes holes 120 as shown in FIG. 3. Locking pins as shown in FIG. 11 are adapted to be inserted into holes 120. Any number of locking pins 118 may be utilized although particularly good results for the interlocking mechanism have been achieved by using three locking pins 118 spaced 120 degrees apart about the axis 122, as shown in FIG. 3

Figure 10:
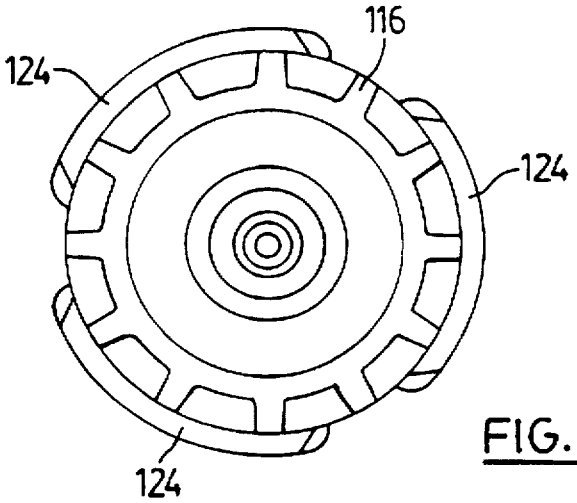
FIG. 10 is a bottom view of the cap.

The cap 90 includes a plurality of flanges 124 which extend radially beyond said ribs 116 and are adapted to interlock with the locking pins 118. In particular, three flanges 124 are utilized as shown in FIG. 10 which flanges 124 are equally spaced around the exterior surface of cap 90. The flanges 124 are spaced apart from one another so as to accommodate the insertion of locking pins 118. In particular, the cap 90 is releaseably secured to the beverage container 4. Thereafter the beverage container 4 is inserted downwardly into the carbonation device 2 so that nozzle 60 is inserted fully in cavity 94 and is held securably therein. Beverage container 4 as well as the cap 90 is pushed downwardly as shown in FIG. 11 so that the locking pins 118 clear the spaces between the flanges 124. Beverage container 4 is rotated so that the flanges 124 on cap 90 slide under said locking pins, thereby locking said cap 90 to said carbonation device 2 as shown in FIG. 11.

Although the flanges 124 are located on the cap 90 and the projections or capturing means 118 on the device, the flanges 124 could be located on the device and the projections 118 or capturing means could be located on the cap 90.

Figure 17:
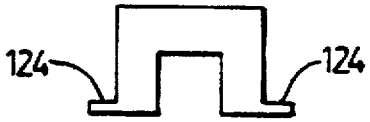
FIG. 17 shows another view of FIG. 16.

An alternative embodiment of an interlocking device is shown in FIGS. 17 and 18 where the device includes a releasable locking collar 160 which is adapted to receive and tighten around the flanges 124 of cap 90 when the cap is inserted onto the nozzle 60. The tabs 162 move together so that the collar 160 captures the flanges 124.

Accordingly once the beverage container 4 is locked into position as shown in FIG. 2 or FIG. 11, the plunger 98 opens the nozzle valve 62 so as to permit the introduction of carbon dioxide gas into the beverage container 4 as previously described herein. O-ring 136 is disposed between said nozzle 60 and said cavity 94 to prevent the leakage of gas. However, in order to initiate the flow of carbon dioxide gas from carbon dioxide container into the beverage container 4, the switch 40 must be switched to the on position causing the piston 32 to open valve 30 thereby opening the passage between the inlet 26 and outlet 28 of the valve means 18 so as to cause the flow of $CO_2$ gas up into the pressure regulating means and then up into beverage container 4. Once the contents of beverage container 4 are sufficiently carbonated, the switch 40 is then moved to the off position. The beverage container 4 from carbonation device 2 may then be rotated so as to free the locking pins 118 from flanges 124 permitting the withdrawal of beverage container 4.

The button cap 114 includes orifice 134 to permit the passage of $CO_2$ gas from output washer 110 into beverage container 4. Orifice 134 has angled surfaces 122 which assist in the orderly escape of carbon dioxide gas. In other words, angled surfaces 122 ensure that the carbon dioxide bubbles reach all parts of the interior of beverage container 4.

The carbon dioxide container 10 includes a gas regulator 130 which is well-known to those persons skilled in the art and also includes a safety knot 132 which is threadably secured into the regulator 130 again in a manner well-known to those persons skilled in the art, as FIG. 2 best illustrates.

Figure 13:
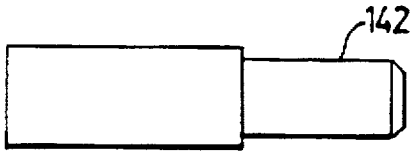
FIG. 13 is a side-elevational view of the pusherpin.
Figure 14:
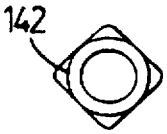
FIG. 14 is a top view of the pusherpin.
Figure 16:
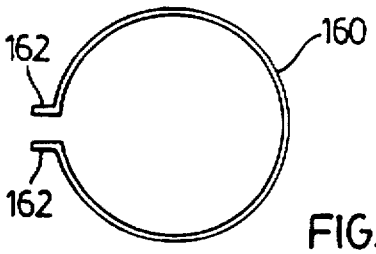
FIG. 16 shows an alternative embodiment of the interlocking device.

The gas regulator 130 includes a passage 134 which communicates with the inside of the carbon dioxide container 10. The passage 134 also includes a valve 136 which is adapted to be activated by pushpin 140 which is more fully particularized in FIGS. 13 and 14. The size of the lower body of pushpin 140 as shown in FIG. 4 is slightly larger than the rounded hole 16 of housing 3 so that the pushpin 140 is friction fitted therein. The pushpin 140 also includes activating pin 142 which opens valve 136 to open during the threaded insertion of carbon dioxide container 10 and regulator 130 into the housing 3 in a manner as well-known to those persons skilled in the art. Once the carbon dioxide container 10 is threadably inserted into the housing 4, the carbon dioxide gas is released into the passage 14 as described above. Moreover the carbon dioxide container 10 also includes a gas tube 150 as well known to those persons skilled in the art.

Accordingly the operation and the use of the carbonation device 2 shall now be described. Initially the carbon dioxide container 10 is threadably secured to the housing 3 by threadably rotating the gas regulator 130 and carbon dioxide container 10 as shown in FIG. 2 so that the activating pin 142 opens valve 136 Thereafter the beverage container 4 is filled with the appropriate beverage and cap 90 is threadably secured thereto as described above. Thereafter the beverage container 4 is tipped upside down so that the cap 90 engages the nozzle 60 so that the flanges 124 rotatably capture the locking pins 118. This action causes the plunger 98 to open nozzle pin 62. The switch 40 is then activated to open high-pressure valve 30 to permit the introduction of carbon dioxide gas through the passageways into the beverage container 4. Once sufficient carbonation has been achieved the switch 40 is moved to the off position and thereafter the beverage container 4 may be removed.

The high-pressure relief valve 18 utilized herein permits easy operation of the device and permits the introduction of carbon dioxide gas from $CO_2$ container 10 into beverage container 4 in an effortless manner.

Moreover the cap 90 utilized herein permits ease of insertion and locking of the beverage container 4 during carbonation. Moreover the locking mechanism comprising of locking pins 118 and flanges 124 ensures positive engagement of the parts during operation.

In the cap the spring 102, metal ball 106 (if it is made of metal) and the washer 110 is passivated (ie. subjected to an acid bath).

It has been found that good results occur when the beverage container 4 is filled with water to 85% of its capacity. Then the container 4 is interlocked with the device 2 as described and $CO^2$ gas is introduced into the container as described. Then the beverage container 4 is removed and vigorously shaken to set the carbonation with the solution, the container 4 may be manually shaken or shaken by a device attached to the unit 2. At this point the user has made soda water. "Pop" can be made by adding a concentrated syrup of different flavours. Low alcohol beer, wine and coolers can be made in the same fashion.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed defined as follows:

1. An interlocking device including;

a a plurality of protecting locking pins adapted to protrude from a carbonation device where said carbonation device introduces carbon dioxide gas into a beverage container;

b a plurality of radially extending ribs adapted to be on an exterior surface of a cap, wherein said ribs run axially along the length of said cap;

c rotatable capturing means adapted to be on said cap, extending outwardly beyond the exterior surface of said cap for capturing said projecting locking pins so as to look said cap to said carbonation device;

d wherein said rotatable capturing means comprises a plurality of spaced flanges extending radially outwardly beyond said exterior surface of said cap, said flanges adapted to receive said locking pins between said spaced flanges and to slide under said locking pins when said cap is rotated.

2. An interlocking device as claimed in claim 1 wherein said plurality of flanges comprises three spaced flanges.

3. An interlocking device as claimed in claim 2 wherein said locking pins are disposed 120 degrees relative each other and said flanges are disposed 120 degrees relative to each other.

4. An interlocking device comprising:

a three projecting locking pins disposed 120° relative to each other, said projecting locking pins adapted to protrude from a carbonation device where said carbonation device introduces carbon dioxide gas into a beverage container;

b a plurality of radially extending ribs adapted to be on the exterior surface of a cap, wherein said ribs run axially along the length of said cap for enlarging the body of said cap;

c three spaced apart flanges disposed 120° relative each other and extending radially outwardly beyond said exterior surface of said cap, said flanges adapted to receive said locking pins between said spaced flanges and to slide under said locking pins when said cap is rotated so as to capture said projecting locking pins so as to lock said cap to said carbonation device;

d a nozzle adapted to be presented by said carbonation device;

e a cavity presented by said cap, said cavity adapted to receive said nozzle and to hold said nozzle securably in place;

f sealing means disposed between the surface of said nozzle and said cavity; and g plunging means centrally disposed within said cavity to open said nozzle when said nozzle is inserted fully into said cavity and said cap is locked to said carbonation device.

5. An interlocking device as claimed in claim 4 wherein:

(a) said cavity is cylindrical; and (b) said surface of said nozzle defines an exterior cylindrical surface.

6. An interlocking device as claimed in claim 5 wherein said sealing means comprises O-rings.

7. A device for carbonating beverages including:

(a) a housing presenting passage means;

(b) a high pressure carbon dioxide container releasably securable to said housing at one end of said passage means;

(c) a beverage container releasably enageable with said housing for communication with an other end of said passage means;

(d) a valve body disposed within said passage means extending longitudinally so as to present two opposite ends thereof with a bore extending between said ends and a hole disposed between said ends and communicating with said bore for defining an outlet;

(e) a valve disposed within said valve body adjacent said one of said ends defining an inlet for communication with said passage means, said valve activateable between an open position to permit communication of said gas from said carbon dioxide container through said inlet, into said passage means out said outlet, into said beverage container so as to carbonate said beverage, and a closed position to stop communication of said gas between said inlet and said outlet;

(f) a piston disposed within said valve body extending into said bore for activating said valve, said piston moveable between a closed position where said piston is spaced from said valve, to an open position where said piston contacts said valve;

(g) a support disposed within said bore adjacent said other end of said valve body, said support including a centrally disposed longitudinal passageway, for slidably supporting said piston between said open and closed positions;

(h) a moveable switch for moving said piston and said valve between said open and closed positions;

(i) pressure regulating means for reducing the pressure of said pressurized gas from said carbon dioxide container to said beverage container;

(j) a cap for sealing the end of said beverage container, the contents of which are to be carbonated by the release of said pressurized gas from a nozzle having a valve, said cap including cavity means for sealingly receiving said nozzle and engaging said valve to release said carbonated gas, said cap including cap passage means for communication of said carbonation gas from said valve to said end of said beverage container, and a cap valve means moveable between a closed position to close said end of said beverage container and an open position so as to carbonate said beverage when said cavity means engages said valve to release said carbonated gas;

(k) said housing including a plurality of projecting locking pins, and said cap including a plurality of radially extending ribs running axially along the length of the cap and a plurality of flanges extending beyond said ribs adapted to rotatably capture said locking pin so as to lock said cap to said housing during carbonation of said beverage container.

* * * * *